United States Patent [19]

Speich

[11] Patent Number: 4,572,247

[45] Date of Patent: Feb. 25, 1986

[54] SINGLE HEDDLE CONTROL DEVICE FOR A WEAVING MACHINE HAVING A SHEDDING APPARATUS

[75] Inventor: Francisco Speich, Gipf-Oberfrick, Switzerland

[73] Assignee: Textilma AG, Hergiswil, Switzerland

[21] Appl. No.: 544,597

[22] Filed: Oct. 24, 1983

[30] Foreign Application Priority Data

Oct. 26, 1982 [CH] Switzerland ..... 6250/82

[51] Int. Cl.[4] ..... D03C 13/00; D03C 5/00; D03C 3/20

[52] U.S. Cl. ..... 139/455; 139/79; 139/319

[58] Field of Search ..... 139/455, 456, 55.1, 139/319, 79–81

[56] References Cited

U.S. PATENT DOCUMENTS 2,204,891 6/1940 Hamilton ..... 139/455
3,265,096 8/1966 Zangerle et al. ..... 139/59
3,410,314 11/1968 Hopf ..... 139/80 X
3,835,894 9/1974 Speich ..... 139/455

FOREIGN PATENT DOCUMENTS 8812 of 1894 United Kingdom ..... 139/319
8217 of 1896 United Kingdom ..... 139/319

*Primary Examiner*—James Kee Chi
*Attorney, Agent, or Firm*—Toren, McGeady, Stanger, Goldberg & Kiel

[57] ABSTRACT

A single heddle control device having a selecting device containing lifters which are actuated by knives of a knife device. The knife device is connected in a drive arrangement with a shaft drive of a weaving machine and the selecting device has coupling means which are formed from the lifters and electromagnetically actuated control projections. The coupling means arrest the lifters in a starting position which corresponds to the stroke position which opposes a pretensioning force of the single heddles. The electromagnets of the selecting device are connected with an electronic pattern control apparatus.

8 Claims, 8 Drawing Figures

SINGLE HEDDLE CONTROL DEVICE FOR A WEAVING MACHINE HAVING A SHEDDING APPARATUS

The present invention relates generally to control apparatus for weaving machines and more particularly to a mechanism which constitutes a single heddle control device for a weaving machine having a shedding apparatus.

In devices of the type to which the present invention relates, selecting means operate to couple the heddles of a weaving machine or loom with drive means for driving the heddles against a pretensioning force. The heddles must be controlled in accordance with a pattern determining the manner in which the warp threads of the loom or weaving machine are to be guided.

In weaving machines having shedding apparatus in the form of shafts, the control of single heddles for patterning the weft to be produced may cause difficulties. As a rule, in such weaving machines, there are provided several shafts in which single heddles are stretched serving to control the warp threads. This gives rise to a disadvantage in that in such weaving machine, there must be provided a plurality of shafts. This not only necessitates a rather complicated drive arrangement, but it also may cause an increase in the structural dimensioning of the apparatus because of the plurality of shafts which are required. Despite this, such weaving machines are found to be very limited in terms of the variations which are possible.

In the prior art, for example, U.S. Pat. No. 3,835,894 there is described a single heddle control device of the type referred to herein wherein separate drives are necessary for driving the individual coupling means controlling the single heddles. Such an arrangement is not unusual for jacquard machines. Accordingly, in such machines there results complicated and expensive single heddle control devices which are found to be unsuitable for subsequent installation in weaving machines having shedding apparatus as well as with respect to the structural volume and economy provided.

Accordingly, the present invention is directed toward provision of a single heddle control device which, particularly, is also subsequently attachable at weaving machines having a shedding apparatus and which is distinguished by the simplicity of its construction and its capability for enabling wide variations.

SUMMARY OF THE INVENTION

Briefly, the present invention may be described as a single heddle control device for a weaving machine having a shedding apparatus comprising a selecting device having coupling means for each single heddle, means applying to each heddle a pretensioning force in one direction, drive means for driving the heddles against the force of the pretensioning means, electromagnetic means for selectively connecting the coupling means with the drive means and an electronic pattern control device for operating the electromagnetic means. The selecting device is formed with a knife device including a plurality of knives which are adapted to be coupled with the drive means. Furthermore, the coupling means comprise lifters having carrier projections thereon which cooperate with the knives to effect coupling of the knives with the drive means.

The present invention achieves the results intended in that the coupling means of the single heddle control device are connected directly at the shedding device or at a shaft frame, and a separate drive of the single heddle control device is no longer necessary, thereby achieving a relatively simple construction of the single heddle control device which is not only economical but which particularly also requires less structural volume so that a subsequent installation in a weaving machine with a shedding apparatus is possible. Moreover, the construction in accordance with the invention provides a further substantial advantage in that the control characteristics of the shedding apparatus may be utilized in addition to the control characteristics of the selecting device of the single heddle control device thereby resulting in a greater number of control possibilities of the single heddle control device without requiring additional expenditures.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
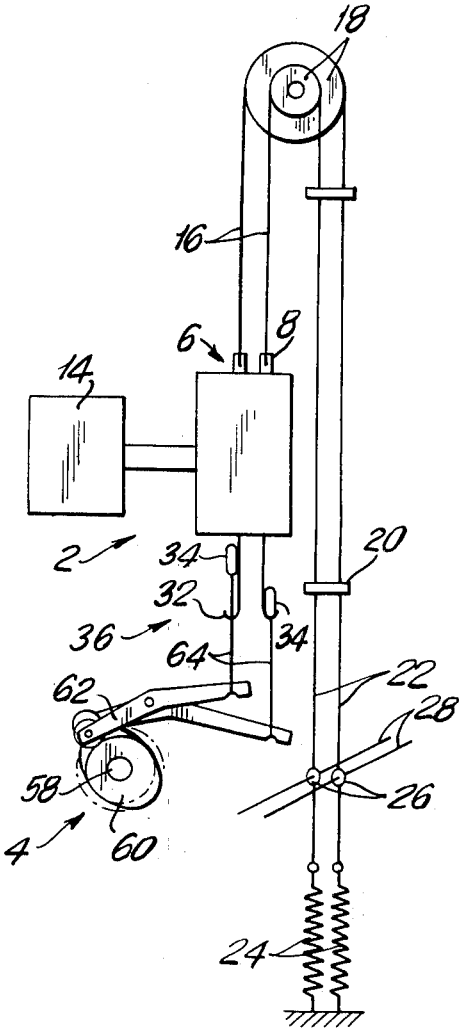
FIG. 1 is a schematic diagram showing in side view a single heddle control device for a single stroke.

Referring now to the drawings and particularly to FIG. 1, there is shown a single heddle control device including a selecting device 2 which is coupled in a drive arrangement with a shaft drive 4 of a weaving machine (not shown). The selecting device 2 contains coupling means 6 which are constructed as lifters 8 and which are controllable by means of electromagnets 10 best seen in FIG. 5 or by electromagnets 12 shown in FIG. 6.

These electromagnets are connected with an electronic pattern control device 14. Harness threads 16 are connected above at the lifters 8 and they are guided downwardly by deflecting guide rollers 18. Further guidance is provided by a beam-like guide board 20 to the single heddles 22. The single heddles 22 are pretensioned downwardly for example by means of springs 24. Heddle eyes 26 arranged in the single heddles 22 serve to guide threads 28 which lie in the warp direction. Although the threads 28 are, as a rule, warp threads, they may in certain cases also be individually fed threads for special tasks such as, for example, auxiliary threads for tying filling yarn loops in a needle weaving machine.

Figure 4:
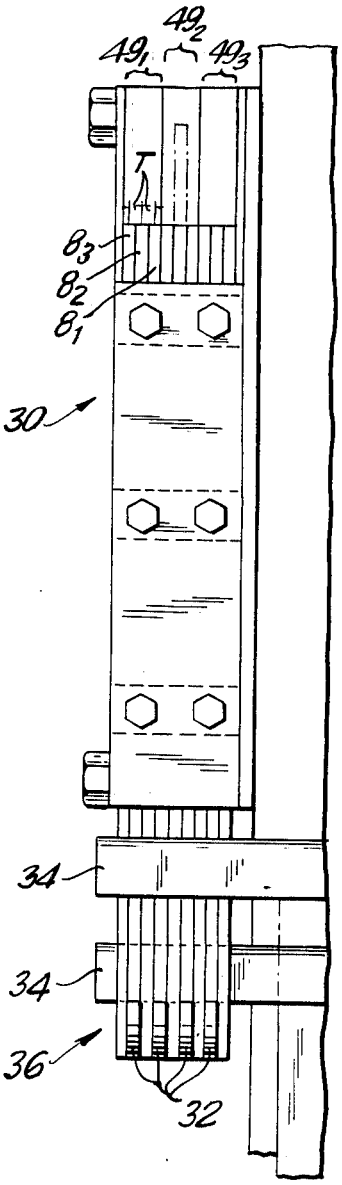
FIG. 4 is a front view showing a selecting device of the control device of the invention.
Figure 5:
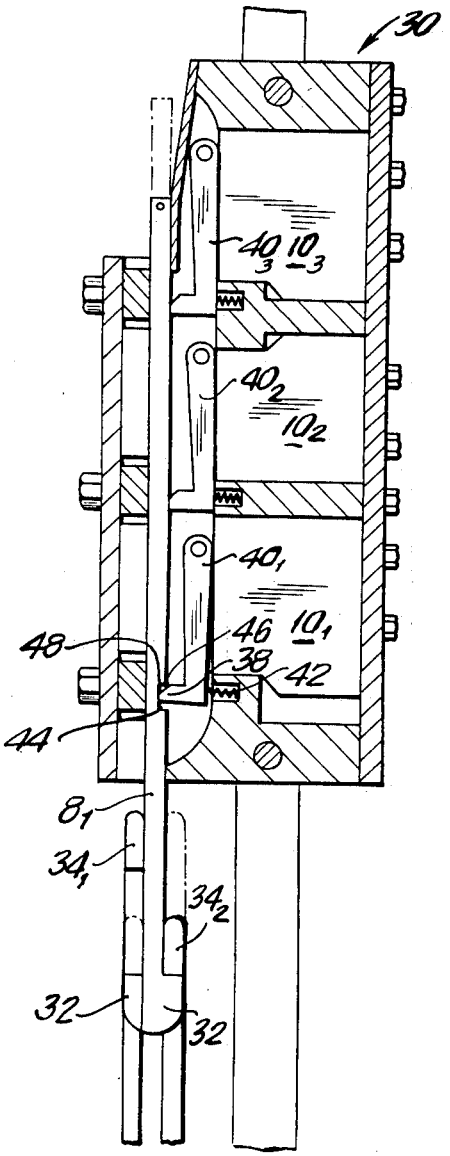
FIG. 5 is a sectional view of the selecting device shown in FIG. 4.

The selecting device of the control apparatus of the invention is shown in greater detail in FIGS. 4 and 5. The lifters are supported in a housing 30 of the selecting device 2 in a manner so as to be displaceable in the vertical direction. A carrier projection 32 is arranged at the lower end of the lifters, for example the lifter $8_1$ shown in FIG. 5.

The carrier projections 32 cooperate with knives $34_1$, $34_2$ of a knife device 36, the knife device 36 being coupled with the shaft drive 4. The lifter $8_1$ is locked at a starting position which corresponds to the extreme position of the knife $34_1$, $34_2$ of the knife device which opposes pretensioning of the single heddle 22 and the harness thread 16. Accordingly, the lifter $8_1$ can only follow movement of the knife 34 under the influence of the heddle pretensioning means when the locked state is released, as indicated in dashed lines in FIGS. 4 and 5.

A control projection 38 is arranged at a pawl $40_1$ which is pivotably supported in the housing 30 and pretensioned against the lifter by means of a spring 42. The pawl $40_1$ serves to lock the lifter $8_1$ in place. A catch stop 44 which is constructed in the form of a recess at which the control projection 38 is fixed in the locked state is provided at the lifter. Furthermore, bevels 46 and 48 are provided on the side opposite the engaging surface at the control projection 38 as well as at the recess of the catch stop 44, the bevels 46, 48 facilitating engagement or disengagement, respectively, of the control projection 38 at the catch stop 44.

Electromagnets such as an electromagnet $10_1$ cooperate with the pawls 40 and draw these pawls back against the pretensioning force of the spring 42. This serves to release the locking engagement with the lifters and the lifters, for example the lifter $8_1$, may then follow the knife $34_1$, $34_2$ of the knife device 36 corresponding to the pretensioning of the heddle.

In the embodiments shown in FIGS. 4 and 5, the lifters 8 are constructed as flat strips or bands and three lifters, such as the lifters $8_1$, $8_2$, $8_3$, are in each instance combined into a structural component such as the components $49_1$, $49_2$, $49_3$, wherein the lifters are arranged laterally adjacent each other. Accordingly, there are also provided three electromagnets $10_1$, $10_2$, and $10_3$ arranged one above the other which actuate three pawls $40_1$, $40_2$, and $40_3$ arranged one above the other. The electromagnets are constructed as flat magnets wherein their thickness corresponds to three times the lifter spacing or separation T. Accordingly, extraordinarily flat structural components are provided with the result that they can be arranged in series relative to one another as desired. Three such structural component groups are shown in FIGS. 4 and 5. It is also shown in FIGS. 4 and 5 that the knife device 36 may have two knives $34_1$ and $34_2$ which can be controlled in the same phase or cycle or in a different phase. In those lifters which cooperate with the second knife $34_2$, the carrier projections 32 are directed in the corresponding direction of the knife $34_2$.

Figure 6:
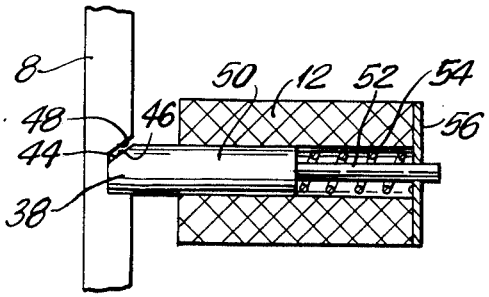
FIG. 6 is a schematic side view partially in section showing a modification of the magnetic arrangement for the selecting device of the invention.

FIG. 6 shows a modified form of the device for locking the lifters 8 in position wherein the control projection 38 is arranged at an anchor 50 which is displaceably supported in an electromagnet 12. The anchor 50 has an offset part 52 having a spring 54 arranged thereabout which is supported by a housing cover 56 of the electromagnet 12 and which pretensions the anchor 50 against the lifter 8. This arrangement is distinguished by its particularly simple structure which, however, requires a lateral structural dimension which is somewhat larger than that of the device shown in FIGS. 4 and 5.

With reference to the device shown in FIG. 1, the shaft drive 4 consists of a treadle device which contains a driven shaft 58 upon which there are fastened cams 60. Two-armed levers 62 are connected with the knife device 36 by means of connecting members 64 and they act upon the cams 60. The knives 34 of the knife device 36 may be suspended analagously to the shaft frame. The cams 60 of the shaft drive 4 are possibly arranged at the shaft 58 so as to be adjustable so that the control of the single heddles may be further varied.

Figure 2:
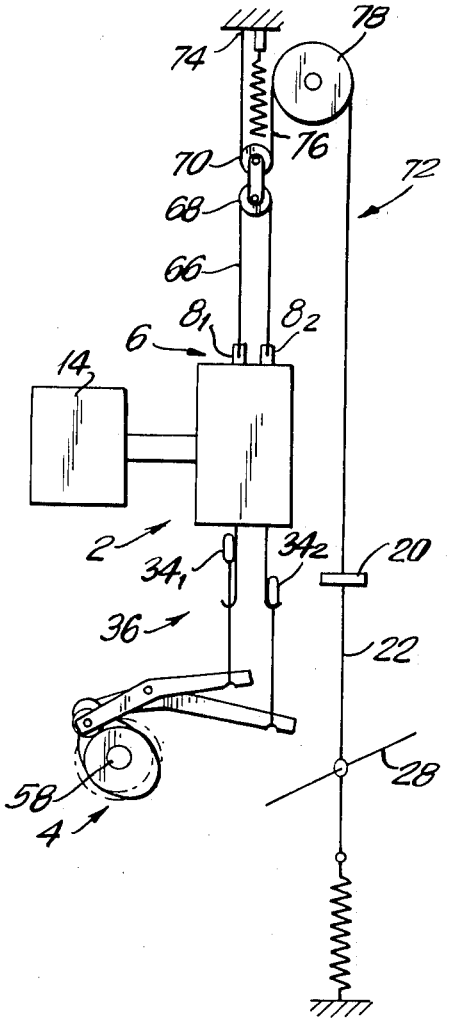
FIG. 2 is a schematic diagram showing in side view a single heddle control device for double stroke.

FIG. 2 shows a further embodiment of the invention wherein a single heddle control device corresponding substantially to the embodiment shown in FIG. 1 is depicted. In the embodiment of FIG. 2, however, two lifters $8_1$, $8_2$ assigned to different knives $34_1$, $34_2$ are connected with one another by means of a connecting thread 66. A pulley tackle device provides a connection between the lifters $8_1$, $8_2$ and at least one harness thread 72. The connecting thread 66 is guided by means of a deflecting roller 68, and another deflecting roller 70 which operates to guide the harness thread 72 is connected with the roller 68. The harness thread 72 is securely fastened at one end 74 thereof at the frame. The other part 76 of the harness thread 72 is guided in turn to a beam-like guideboard 20 by means of a deflecting roller 78 and is connected with a single heddle 22. In this embodiment of the single heddle control device, the single heddle 22 executes a movement in accordance with a so-called double stroke form of operation, that is, it performs one stroke per filling woof.

Figure 3:
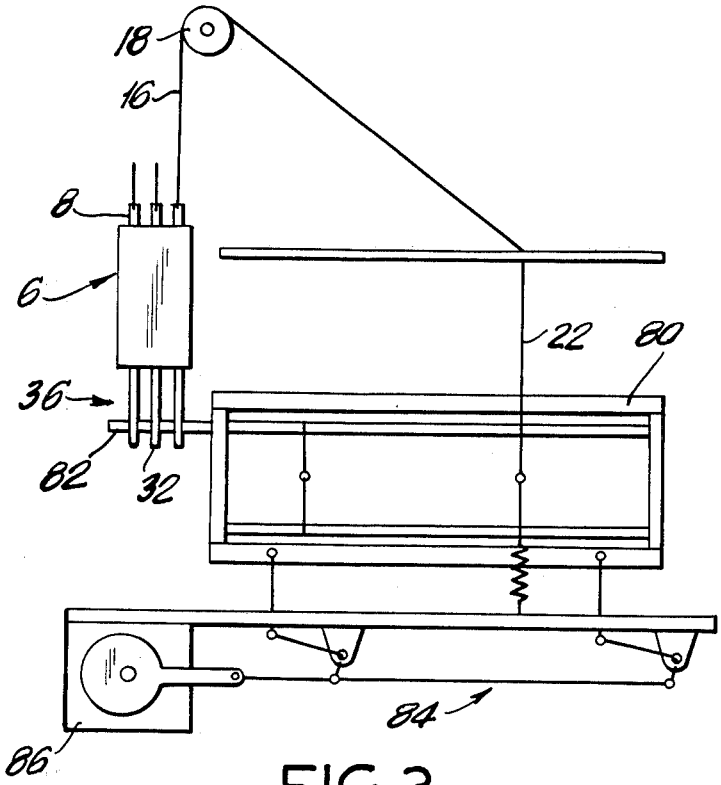
FIG. 3 is a schematic front view showing a single heddle control device coupled with a shaft frame.

FIG. 3 depicts a further embodiment of the invention comprising a single heddle control device wherein the knife device 36 is directly connected with a shaft frame 80. For this purpose, the shaft frame has a projection 82 which acts directly as a knife, which cooperates with the carrier projections 32 of the lifters 8. The shaft frame 80 is connected with a drive mechanism 86 by means of a lever gear unit 84. With regard to other aspects thereof, the manner of operation of this single heddle control device corresponds to the single heddle control devices already described above.

Figure 7:
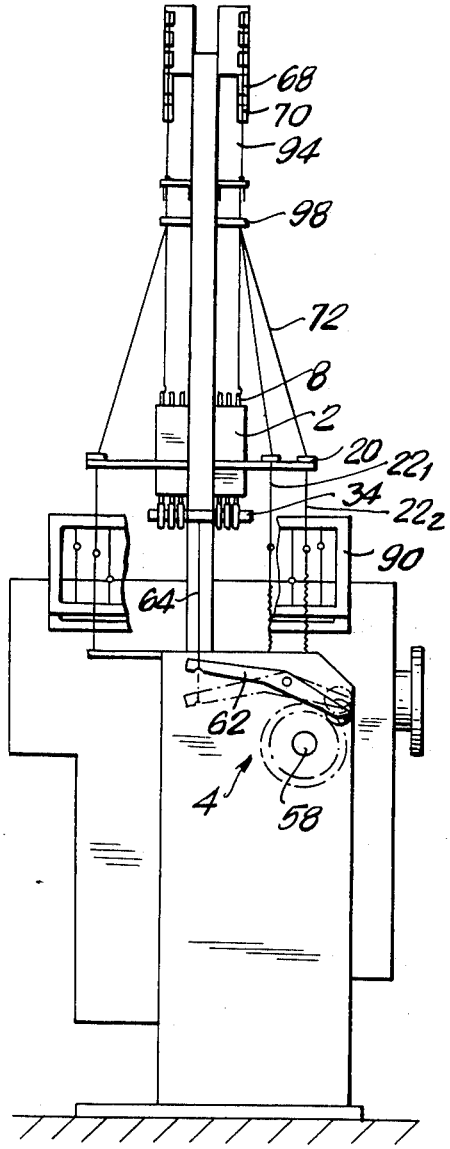
FIG. 7 is a front view of a weaving machine having a single heddle control device.
Figure 8:
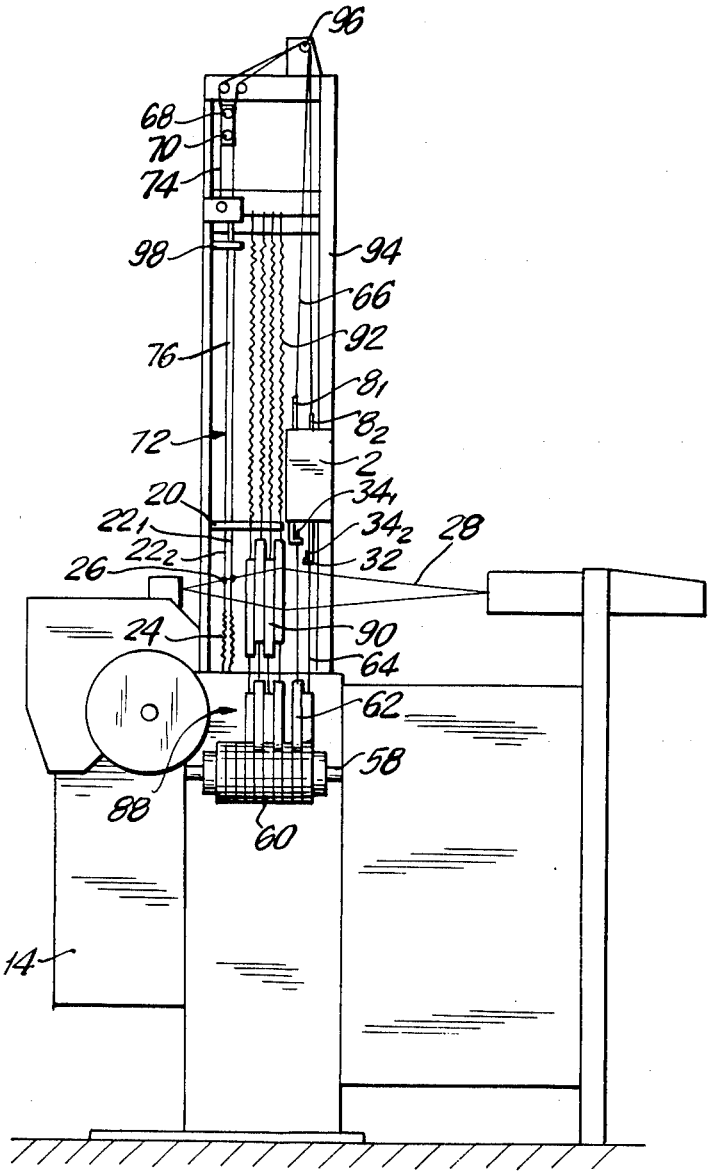
FIG. 8 is a side view of the weaving machine shown in FIG. 7.

FIGS. 7 and 8 show an arrangement of a single heddle control device similar to that of FIG. 2 in a weaving machine having a shedding apparatus 88 which is formed from a shaft drive 4, constructed as a treadle device, at which various shaft frames 90 are connected. The shaft drive 4 has a drive shaft 58 at which the cams 60 are connected. Double-armed levers 62, which are connected by means of connecting members 64 with the shaft frame 90 on one side, and on the other side with the knives 34 of the knife device 36, act on the cams 60. The shaft frames 90 are suspended in a frame 94 for the shaft frames by means of pretensioning springs 92. The structural components of the selecting device 2 are also fastened at this frame 94. In the embodiment shown, two lifters $8_1$ and $8_2$ driven by two different knives $34_1$ and $34_2$ of the knife device 36 are connected with one another by means of a connecting thread 66. In a manner which is analagous to that shown in connection with the embodiment of FIG. 2, the connecting thread 66 is guided by means of a deflecting roller 96 at the frame 94 to a deflecting roller 68 which is connected with the deflecting roller 70 for the harness threads 72. One end 74 of the harness threads 72 is fastened, in each instance, at the frame and the other part 76 is guided to two single heddles $22_1$, $22_2$ by means of an upper guideboard 98 and the lower beam-like guideboard 20. In the example depicted, two lifters $8_1$, $8_2$ which are connected with each other control the single heddle threads $22_1$ and $22_2$ in accordance with the principle of double stroke control. A desired quantity of structural components of the selecting device 2 and a desired quantity of single heddles 22 can be controlled with this single heddle control device.

FIG. 8 also shows the manner in which the shaft frames 90 and the single heddles $22_1$, $22_2$ control the threads for forming a warp shed.

Thus, it will be seen that the present invention provides an advantageous construction wherein in its more specific aspects various advantages may be obtained.

For example, the carrier projections 32 of the lifters $8_1$, $8_2$, $8_3$ are arranged beneath a support containing the electromagnets 10, 12 wherein harness threads 16, 72 or connecting threads 66 are connected above at the lifters and are again guided downwardly to at least one harness preferably by means of rolling deflecting devices. Although the single heddle control device can possibly be driven from above, a construction of the type described above is particularly advantageous and simple, since here the coupling members between the selecting device and the shedding apparatus of the weaving machine may be particularly maintained small and simple.

A simple fastening of the electromagnets of the selecting device can be achieved in that the electromagnets 10, 12 are capable of being fastened at the frame 94 for the shaft frames 90 and in that the guide 20 for the harness threads 16, 72 connecting the single heddles 22, $22_1$, $22_2$ with the lifters 8, $8_1$, $8_2$, $8_3$ is constructed as at least one beam-like guideboard to be arranged parallel to the shaft frames 90.

Control of the lifters may be effected in accordance with a preferred embodiment of the invention in that the lifters 8, $8_1$, $8_2$, $8_3$ have a catch stop 44 preferably constructed as a recess against which the control projection 38 is tensioned, the projection 38 being retractable by means of the electromagnets 10, 12, the control projection 38 being arranged at an anchor 50 supported in the electromagnet 12 so as to be axially displaceable.

The engaging and disengaging of the control projection 38 is improved by means of the construction wherein the stroke of the knife device 36 during each stroke cycle extends beyond the catch position of the lifters 8, $8_1$, $8_2$, $8_3$ to the extent that the locked control projections 38 can be relieved from the catch stop 44 of the lifters and can engage with bevels 46, 48 arranged at the sides of the control projections 38 or of the lifters 8, $8_1$, $8_2$, $8_3$, respectively, which sides are located opposite the catching surfaces of the control projections 38 and/or the catch stops 44.

A particularly flat and compact construction of the selecting device of the single heddle control device may be achieved in accordance with the arrangement wherein a number n of lifters $8_1$, $8_2$, $8_3$, wherein the number n is preferably equal to 3, are combined into a structural component wherein the lifters are arranged laterally adjacent one another and wherein the electromagnets $10_1$, $10_2$, $10_3$ are arranged one above the other in the longitudinal direction of the lifters $8_1$, $8_2$, $8_3$. Several such structural components can be arranged adjacent each other in accordance with the quantity of the single heddles which are desired to be controlled.

While specific embodiments of the invention have been shown and described in detail to illustrate the application of the inventive principles, it will be understood that the invention may be embodied otherwise without departing from such principles.

What is claimed is:

1. A single heddle control device for a weaving machine having a shedding apparatus including one of a shaft drive and a shaft frame comprising: a selecting device including coupling means comprising a plurality of lifters each connected with a single heddle, each of said lifters comprising a carrier projection; means applying to each heddle a pretensioning force in one direction; reciprocating drive members each engaging one of said carrier projections for driving said heddles against the force of said pretensioning means; engagement detents formed in each of said lifters; pawl means engaging in said detents for restraining movement of said lifters; electromagnetic means for disengaging said pawl means from said detents; and an electronic pattern control device for selectively controlling operation of said electromagnetic means; said reciprocating drive members each comprising a knife which is directly connectable with one of said shaft drive and said shaft frame of said shedding apparatus.

2. A device according to claim 1 wherein said carrier projections of said lifters are arranged beneath a support containing said electromagnetic means, said device further including harness threads connected above said lifters and arranged to be guided subsequently in a downward direction to at least one harness by means of rolling deflecting devices.

3. A device according to claim 10 wherein said weaving machine includes a frame for said shaft frame and wherein said electromagnetic means are fastenable at said frame for said shaft frames, said device also comprising a guide for harness threads connecting said single heddles with said lifters, said guide being constructed as at least one beam-like guideboard arranged parallel to said shaft frame.

4. A device according to claim 3 wherein said pawl means comprise pivotally mounted pawl.

5. A device according to claim 4 wherein said detents comprise a catch stop and wherein said pawl means comprise a control projection which is retractable by operation of said electromagnetic means, said control projection being pretensioned against said catch stop and being arranged at an anchor which is supported in said electromagnetic means so as to be axially displaceable.

6. A device according to claim 5 wherein said knife undergoes a stroke during each stroke cycle of said device, wherein said detents include a catch stop, wherein said pawl means include locked control projections which engage within said catch stops of said detents to hold said lifters at a catch position, said catch stops and said control projections defining catching surfaces at which interengagement therebetween is effected, at least one of said control projections or said lifters including bevels arranged at the sides thereof, the stroke of said knife during each stroke cycle extending beyond said catch position of said lifters to the extent that said locked control projections can be relieved from said catch stop of said lifters and can engage with said bevels.

7. A device according to claim 6 wherein a plurality of said lifters are combined into a structural component in which said lifters are arranged laterally adjacent each other and wherein said electromagnetic means comprise electromagnets which are arranged one above the other in the longitudinal direction of said lifters.

8. A device according to claim 7 wherein each of said structural components comprise three of said lifters.

* * * * *